US006366021B1

(12) United States Patent
Meddaugh et al.

(10) Patent No.: US 6,366,021 B1
(45) Date of Patent: Apr. 2, 2002

(54) STANDING WAVE PARTICLE BEAM ACCELERATOR WITH SWITCHABLE BEAM ENERGY

(75) Inventors: Gard E. Meddaugh, Mountain View; Gregory Kalkanis, Cupertino, both of CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/479,466

(22) Filed: Jan. 6, 2000

(51) Int. Cl.[7] ..... H01J 25/10

(52) U.S. Cl. ..... 315/5.41; 315/501; 315/507; 315/506

(58) Field of Search ..... 315/5.41, 5.42, 315/500, 501, 506, 507, 3.39

(56) References Cited

U.S. PATENT DOCUMENTS

| | | | | |
|---|---|---|---|---|
| 4,024,426 A | | 5/1977 | Vaguine | 315/5.41 |
| 4,162,423 A | | 7/1979 | Tran | 315/5.41 |
| 4,286,192 A | | 8/1981 | Tanabe et al. | 315/5.41 |
| 4,382,208 A | | 5/1983 | Meddaugh et al. | 315/5.41 |
| 4,400,650 A | * | 8/1983 | Giebeler, Jr. | 315/5.41 |
| 4,629,938 A | | 12/1986 | Witham | 315/5.41 |
| 4,651,057 A | | 3/1987 | Uetomi et al. | 315/5.41 |
| 4,746,839 A | | 5/1988 | Kazusa et al. | 315/5.41 |
| 5,039,910 A | * | 8/1991 | Moriguchi et al. | 315/5.41 |
| 5,821,694 A | | 10/1998 | Young | 315/5.41 |

* cited by examiner

*Primary Examiner*—Don Wong
*Assistant Examiner*—Tuyet T. Vo
(74) *Attorney, Agent, or Firm*—Flehr Hohbach Test Albritton & Herbert LLP

(57) ABSTRACT

A standing wave particle beam accelerator in which the electric fields in one side coupling cavity are switched by inserting two probes of selected diameter to provide different upstream and downstream electric field coupling to adjacent coupled accelerator cavities.

5 Claims, 2 Drawing Sheets

STANDING WAVE PARTICLE BEAM ACCELERATOR WITH SWITCHABLE BEAM ENERGY

BRIEF DESCRIPTION OF THE INVENTION

This invention relates generally to standing wave particle beam accelerators, and more particularly to charged particle beam accelerators wherein the standing wave in at least one side coupling cavity can be switched to at least two different asymmetries with respect to the coupling of electromagnetic fields to the two adjacent main cavities, to switch the energy of the particle beam.

BACKGROUND OF THE INVENTION

Standing wave particle beam accelerators have found wide usage in medical accelerators where the high energy particle beam is employed to generate x-rays. In this application, the output x-ray energy must be stable. It is also desirable that the energy of the particle beam be switchable readily and quickly to provide x-ray beams of different energies to enable different x-ray penetration during medical treatments.

One technique for controlling the beam energy is to vary the rf energy applied to the accelerating cavities. Other implementations have been described in various patents. In U.S. Pat. No. 4,286,192 to Tanabe and Vaguine the energy is controlled by reversing the accelerating fields in one part of the accelerator to decelerate the beam. In U.S. Pat. No. 4,382,208 to Meddaugh et al., the electromagnetic field distribution is changed in the coupling cavity to control the fields applied to the adjacent resonator cavities. U.S. Pat. No. 4,746,839 to Kazusa and Yoneda discloses the use of two coupling cavities which are switched to control the acceleration fields.

OBJECTS AND SUMMARY OF THE INVENTION

It is an object of the present invention to provide a switchable energy side-coupled standing wave particle beam accelerator.

It is another object of the present invention to provide a switchable energy side-coupled cavity standing wave particle beam accelerator which is switchable to provide three levels of output energy with an insubstantial change in frequency and energy spectrum spread.

To achieve the foregoing and other objects of the invention, the particle accelerator includes an input cavity for receiving the charged particles, intermediate accelerating cavities and an output cavity, and a plurality of coupling cavities connecting adjacent pairs of said cavities along the accelerator, at least one of said coupling cavities including means for switching the magnitude of the electromagnetic field coupling to adjacent cavities between a first level and at least two additional levels to provide output energy at least three levels.

BRIEF DESCRIPTION OF THE DRAWINGS

The foregoing and other objects of the invention will be better understood from the following description when read in conjunction with the accompanying drawings in which.

DESCRIPTION OF THE PREFERRED EMBODIMENTS

Figure 1:
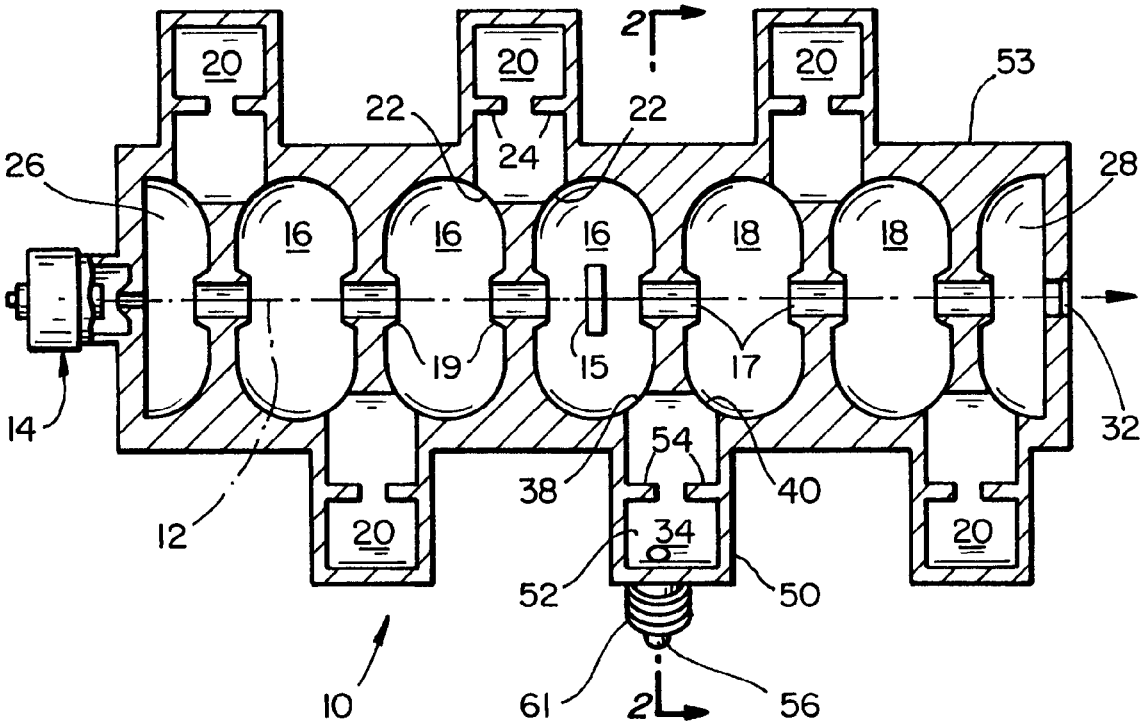
FIG. 1 is a schematic cross-sectional view of a side cavity coupled standing wave particle beam accelerator.

FIG. 1 is a schematic axial sectional view of a charged particle standing wave accelerator structure embodying the invention. It comprises a chain of electromagnetically coupled resonant cavities. A linear beam of electrons 12 is injected into the accelerator by a conventional electron gun source 14. Beam 12 may be either continuous or pulsed.

The standing wave accelerator structure 10 is excited by microwave power at a frequency near its resonant frequency, between 1000 and 10,000 MHz, in one example 2856 MHz. The power enters one cavity 16, preferably one of the cavities along the chain, through an iris 15.

The accelerating cavities of the chain are of two types, 16, 18. The cavities are doughnut shaped with aligned central beam apertures 17 which permit passage of beam 12. Cavities 16 and 18 preferably have projecting noses 19 of optimized configuration in order to improve efficiency of interaction of the microwave power and electron beam. For electron accelerators, the cavities 16, 18 are electromagnetically coupled together through a "side" or "coupling" cavity 20 which is coupled to each of the adjacent pair of cavities by an iris 22. Coupling cavities 20 are resonant at the same frequency as accelerating cavities 16, 18 and do not interact with beam 12. In this embodiment, they are of cylindrical shape with a pair of axially projecting conductive capacitively coupled noses 24.

The frequency of excitation is such that the chain is excited in standing wave resonance with a $\pi/2$ radian phase shift between each coupling cavity and the adjacent accelerating cavity. Thus, there is a $\pi$ radian shift between adjacent accelerating cavities 16, 18. The $\pi/2$ mode has several advantages. It has the greatest separation of resonant frequency from adjacent modes which might be accidentally excited. Also, when the chain is properly terminated, there are very small electromagnetic fields in coupling cavities 20 so the power losses in these non-interacting cavities are small. The first and last accelerating cavities 26 and 28 are shown as consisting of one-half of an interior cavity 16, 18 and as a result the overall accelerator structure is symmetric relative to rf input coupler or iris 15. It is of course understood that the terminal cavities may be fall cavities, the same as cavities 16, 18.

The spacing between accelerating cavities 16, 18 is about one-half of a free-space wavelength, so that electrons accelerated in one cavity 16 will arrive at the next accelerating cavity in right phase relative to the microwave field for additional acceleration. After being accelerated, beam 12 strikes an x-ray target 32. Alternatively, 32 may be a vacuum window of metal thin enough to transmit the electrons for particle irradiation of a subject.

If all the accelerating cavities 16, 18 and all the coupling cavities 20 are similar and mirror-image symmetrical about their center planes, the field in all accelerating cavities will be substantially the same.

In the prior art, as is exemplified in U.S. Pat. Nos. 4,286,192, 4,382,208 and 4,746,839, all of which are incorporated herein in their entirety by reference, at least one coupling cavity is configured to permit control or adjustment of the output energy of the electron beam. In U.S. Pat. No. 4,382,208 the output energy is controlled by making the coupling cavity asymmetrical by a mechanical adjustment. The geometrical asymmetry produces an asymmetry of the electromagnetic field distribution in the coupling cavity 34 so that the magnetic field component is greater at one iris 38 than at the other iris 40. The coupled magnetic field is thus greater in the preceding cavities 16 coupled through iris 38 than in the following cavities 18 coupled through iris 40. Since the cavities 16, 18 are identical, the ratio of accelerating fields in the cavities 16 and 18 is directly proportional to the ratio of magnetic fields on irises 38 and 40. By varying the degree of magnetic asymmetry in the coupling cavity 34, the rf voltage in the accelerating field in the following chain 18 can be changed while leaving the accelerating field constant in the cavities 16 near the beam injection region. Thus, the energy of the output beam can be selectively adjusted.

Since the formation of electron bunches from an initial continuous beam takes place in the first cavities 16 traversed, the bunching can be optimized there and not degraded by the varying the accelerating field in the output cavities 18. The spread of energies in the output beam is thus made independent of the varying mean output electron energy.

The varying energy lost to the beam by the output cavities 18 will of course change the load impedance seen by the microwave source (not shown) producing small reflected microwave power from iris 15. This change is small and can easily be compensated either by variable impedance or by adjusting the microwave input power.

In the prior art, the levels of output energy are generally limited to two levels, a first energy level with the side cavity configured not to disturb the configuration of the fields within the cavity whereby there is equal inductive coupling to the adjacent cavities through the irises 38, 40 and a second energy level wherein the fields within the cavity are changed by changing the physical configuration of the cavity and the inductive coupling through the irises to change the field within the cavities 16, 18 to thereby alter the magnetic field at the two irises.

There is a need in many medical procedures for three or more levels of output energy to form different levels of x-rays for treatment of tumors, etc., which lie at different depths within the patient. The side or coupling cavity in accordance with the present invention is configured with two or more asymmetrically positioned plungers or probes. The probes are preferably circular cylinders although they could be square or other shaped cylinders. Referring now particularly to the coupling cavity 34, FIG. 2, it includes a cylindrical cup-shaped body 50 which forms a cylindrical coupling cavity 52 attached to the main body 53 of the accelerator. Noses or members 54 having opposed end faces extend axially into the cavity. Movable plungers or, probes 56, 57, FIG. 2, extend radially into the cavity through the wall 50 of the cylindrical coupling cavity with their axis defining a "V". This provides physical room for the mechanisms which engage the ends of the probes to advance and retract the probes 56, 57 without mechanical interference. The mechanism (not shown) can comprise electrically actuated solenoids or pneumatically operated cylinders. Movement of the plungers is through the vacuum wall via bellows 61, 62 which provide a vacuum seal. As will be explained, the motion of the plungers is programmed to alter the magnetic fields within the cavity to provide either a symmetric field with both plungers withdrawn, or different asymmetric magnetic fields with one or the other plunger 56, 57 moved into the cavity a predetermined distance from adjacent a nose 54 to alter the magnetic fields which couple to the irises. The asymmetry which is introduced can be controlled by the diameter of the plungers and, secondly and more importantly, by the position of the end of the plunger inside the cavity with respect to the nose 54. Typically, probes upstream of the longitudinal center line of the cavity decrease the magnetic coupling to the downstream iris, and therefore decrease the energy output while probes on the downstream side of the longitudinal center of the cavity increase the downstream magnetic, coupling to the downstream iris and therefore increase the energy output.

Figure 2:
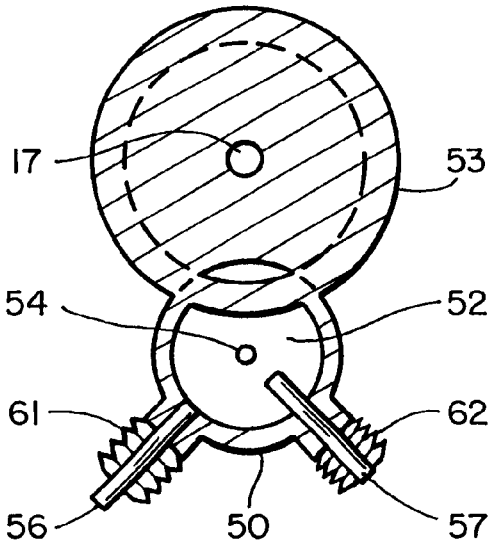
FIG. 2 is a sectional view taken along the line 2—2 of FIG. 1, showing the side cavity in accordance with one embodiment of the invention.
Figure 3:
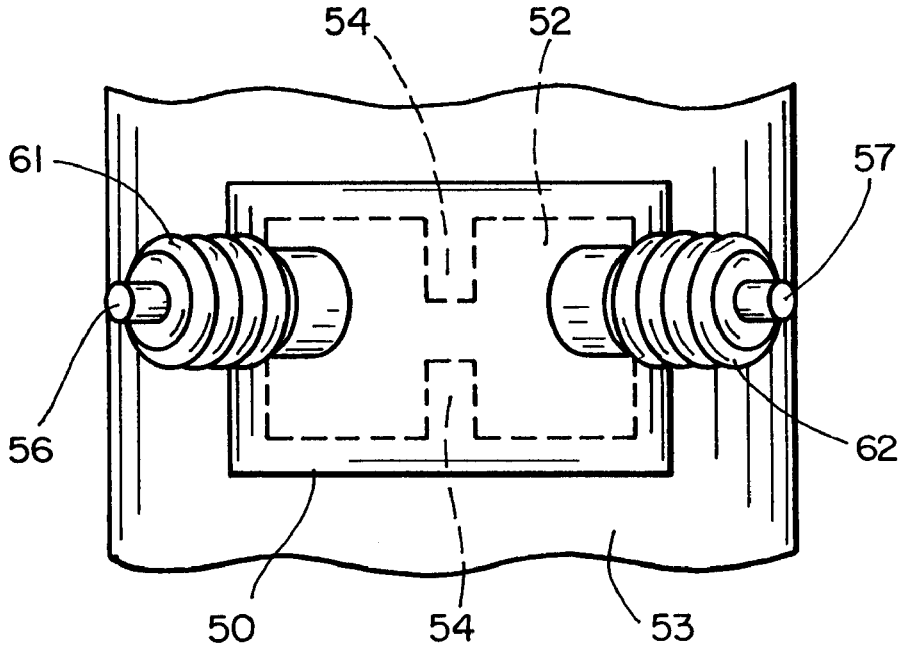
FIG. 3 is an enlarged plan view taken generally along the line 3—3 of FIG. 2.

Since the probes in FIGS. 2 and 3 are located adjacent the upstream nose 54, the degree of insertion and size of one probe can be selected to decrease the magnetic coupling to the downstream iris a first amount as compared to the upstream iris to decrease the output energy by a predetermined amount. The degree of insertion and size of the other probe can be selected to decrease the magnetic coupling by a different amount to decrease the output power by a second amount. In one example, with both probes withdrawn, the output energy was 18 MeV and was shifted to 10 MeV and 6 MeV, respectively, by inserting one or the other of the plungers.

In addition, there are tuning requirements that have not yet been described. In particular, the normal requirement that the switched side-cavity be tuned to the same frequency as are the other side cavities cannot be violated. To do so compromises the stability of the guide. The tuning requirement is fulfilled primarily by varying the diameter of the probe and the degree of insertion. Generally, the upstream and downstream magnetic fields are such that there is no resulting field in the switch cavity.

Figure 4:
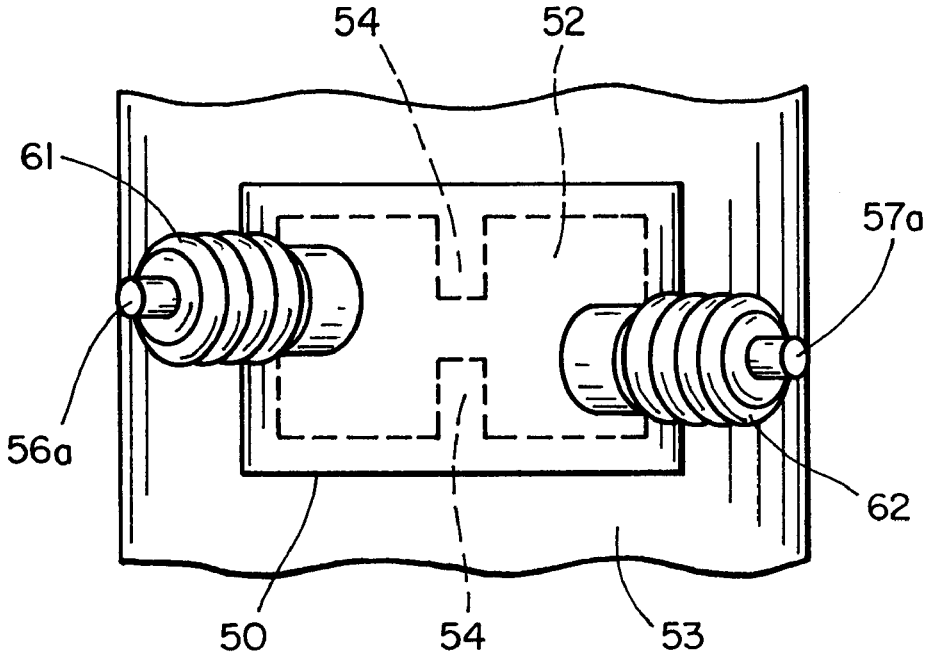
FIG. 4 is a plan view of another embodiment of the present invention.

In FIG. 4, the probes 56*a*, 57*a* are separated longitudinally along the length of the cavity whereby one probe is disposed upstream of the longitudinal center of the cavity and the other downstream. Thus, insertion of the upstream probe 56*a* will decrease magnetic coupling through the downstream iris and decrease the output energy as compared to both probes being withdrawn. Insertion of the downstream probe 57*a* will increase the magnetic coupling through the downstream iris, and increase the output energy as compared to both probes being withdrawn. By way of example, the energy may be increased from 10 MeV to 18 MeV or decreased from 10 MeV to 6 MeV.

Thus there has been provided an accelerator in which the beam energy can be switched to three levels using two radially extending probes. The probes are radially inserted from two different directions in a "V" configuration. This configuration allows the mechanisms which support and move each of the probes to clear one another. The use of two probes provides for insertion of the probes individually with the diameter of the probes selected to maintain resonance and achieve three levels of output power with minimum energy spread.

What is claimed:

1. In an accelerator for accelerating a particle beam, a chain of resonant electromagnetic cavities coupled in series along an axis and resonant at approximately the same frequency, a cylindrical coupling cavity coupled to each of at least two intermediate adjacent cavities through irises, conductors extending parallel to the axis into said coupling cavity with their ends spaced from one another, at least first and second probes mounted for independent radial insertion into said coupling cavity at a radial angle with respect to one another, and with their ends adjacent and selectively coupled to one or the other of said conductors to change the distribution of electromagnetic fields in the cavity whereby the electromagnetic field coupling between said two adjacent cavities is changed with the selective insertion of said probes to thereby change the energy of the particle beam from a first value with both probes retracted and uncoupled to a second value with only one probe inserted and coupled to one conductor and a third value with only the other probe inserted and coupled to one the or the other conductor.

2. The accelerator of claim 1 in which said first and second probes are both on one side of the longitudinal centerline of the coupling cavity.

3. The accelerator of claim 1 in which said first and second probes are on opposite sides of the longitudinal centerline of the coupling cavity.

4. The accelerator of claims 1, 2 or 3 wherein the coupling of the electromagnetic fields to the two adjacent cavities is through irises and the probes change the distribution of electromagnetic field with respect to the irises.

5. The accelerator of claims 1, 2 or 3 an which the diameter of the first and second probes is selected to control the frequency of the cavity.

* * * * *